US007726590B2

(12) United States Patent
Von Bacho, III et al.

(10) Patent No.: US 7,726,590 B2
(45) Date of Patent: Jun. 1, 2010

(54) FUEL INJECTOR DIRECTOR PLATE HAVING CHAMFERED PASSAGES AND METHOD FOR MAKING SUCH A PLATE

(75) Inventors: Paul S. Von Bacho, III, Rochester, NY (US); Julie M. Galante-Fox, Hemlock, NY (US); Sudhakar Das, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 12/150,497

(22) Filed: Apr. 29, 2008

(65) Prior Publication Data

US 2008/0283632 A1 Nov. 20, 2008

Related U.S. Application Data

(62) Division of application No. 11/102,037, filed on Apr. 8, 2005, now abandoned.

(51) Int. Cl.

| | |
|---|---|
| ***B05B 1/06*** | (2006.01) |
| ***B05B 1/02*** | (2006.01) |
| ***B05B 1/14*** | (2006.01) |
| ***B05B 1/00*** | (2006.01) |
| ***F02M 61/18*** | (2006.01) |
| ***F02M 61/00*** | (2006.01) |

(52) U.S. Cl. ..... 239/596; 239/533.2; 239/533.12; 239/601

(58) Field of Classification Search ..... 239/533.2, 239/533.12–533.14, 584, 585.1–585.5, 596, 239/601, 900, 548, 552, 553–562, 566, 567
See application file for complete search history.

(56) References Cited

U.S. PATENT DOCUMENTS

| | | | | |
|---|---|---|---|---|
| 5,899,390 | A * | 5/1999 | Arndt et al. | 239/553 |
| 6,131,827 | A * | 10/2000 | Kurita et al. | 239/533.2 |
| 2004/0262430 | A1 * | 12/2004 | Joseph | 239/533.12 |
| 2006/0097082 | A1 * | 5/2006 | Goenka et al. | 239/533.14 |

* cited by examiner

*Primary Examiner*—Darren W Gorman
(74) *Attorney, Agent, or Firm*—Thomas N. Twomey

(57) ABSTRACT

An improved fuel injection spray director plate including conically chamfered entries to the flow passages through the plate. The conical chamfer may extend part way or all the way through the plate. In a currently preferred embodiment, the chamfer extends only part way through the plate, and the remaining cylindrical portion of the passage provides desirable directional capability for the spray. Preferably, the conical chamfer axis forms an angle with the cylindrical portion axis. Preferably, a flow passage is positioned in the director plate such that the main flow direction of fuel exiting the fuel injector valve is received into the chamfer of the passage. Preferably, a second conical portion is formed in the passage between the first conical portion and the cylindrical portion.

4 Claims, 4 Drawing Sheets

FUEL INJECTOR DIRECTOR PLATE HAVING CHAMFERED PASSAGES AND METHOD FOR MAKING SUCH A PLATE

RELATIONSHIP TO OTHER APPLICATIONS AND PATENTS

This application is a divisional application of U.S. Ser. No. 11/102,037, filed Apr. 8, 2005 now abandoned.

TECHNICAL FIELD

The present invention relates to fuel injectors for internal combustion engines; more particularly, to fuel injectors for injection of fuel through a perforated spray director plate; and most particularly, to an improved director plate for a fuel injector wherein fuel flow through the passages is streamlined, thus reducing the prior art tendency for deposits to form at the entrances and along the walls of the passages.

BACKGROUND OF THE INVENTION

Fuel injected internal combustion engines are well known. In direct-injected engines, the injection tip of the fuel injector extends into the combustion chamber and includes a perforated plate, known in the art as a "spray director plate," for dispersing and directing fuel injected from the injection valve. In a conventional engine fuel injection system, the injection tip of the injector extends into a plenum or rail of the engine's intake manifold where the injected fuel is mixed with intake air before being discharged into the engine's combustion chamber.

As is well known in the automotive arts, the configuration and positioning of a director plate with respect to the injection valve ball and valve seat are critical elements in the most fuel-efficient distribution of fuel into the manifold or firing chamber. A typical fuel injection valve includes a beveled circular seat and a reciprocably-actuated ball that seals against the seat in a circular sealing line.

The perforations through a director plate may be considered as fuel flow passages. It is known in prior art director plates to form a passage by drilling or punching with a tool from either the flow-entrance or flow-exit side, either parallel to or at an angle to the plate axis, resulting in a cylindrical passage having an abrupt corner at the tool entrance and typically a ragged or torn corner at the tool exit. A known problem in prior art fuel injectors is that, over time in use, deposits may build up at the flow entrances and exits to the cylindrical passages, as well as on the sidewalls, adversely affecting the control of the volume and spray pattern of fuel.

What is needed in the art is a fuel injector director plate having an improved configuration of flow passages that results in a reduced propensity to form deposits.

It is a principal object of the present invention to reduce the forming of deposits in the flow passages of a fuel injector spray director plate.

SUMMARY OF THE INVENTION

Briefly described, an improved fuel injection spray director plate in accordance with the invention includes conically chamfered entries to the flow passages through the plate. The conical entry defines a chamfer that may extend part way or all the way through the plate. In a currently preferred embodiment, the chamfer extends only part way through the plate, and the remaining cylindrical portion of the passage provides desirable directional capability for the spray. Preferably, each flow passage is positioned in the director plate such that the main flow direction of fuel exiting the fuel injector valve is included in the cone of the chamfer. In a further refinement of the currently preferred embodiment, a second chamfer having a greater cone angle is provided at the passage entrance to further smooth the flow transition into the passage. The chamfers are preferably formed by successive stamping with tapered punches having increasing cone angles. The last cone angle may be radiused to provide a still smoother fuel entry into the passage.

BRIEF DESCRIPTION OF THE DRAWINGS

The present invention will now be described, by way of example, with reference to the accompanying drawings, in which:

FIGS. 4 through 10 are drawings illustrative of methods for forming flow passages through a director plate in accordance with the invention, wherein FIG. 4 is a cross-sectional view of a director plate showing a preliminary cylindrical passage being punched from the upstream (flow entry) surface of the plate;

FIG. 5 is a cross-sectional view of a director plate showing a preliminary cylindrical passage being punched from the downstream (flow exit) surface of the plate;

FIG. 6 is a cross-sectional view showing a first conical punch being entered into the cylindrical passage shown in FIG. 5;

FIG. 7 is a cross-sectional view of the director plate and passage after first conical punching as shown in FIG. 6;

FIG. 8 is a cross-sectional view showing a second conical punch being entered into the passage shown in FIG. 7;

FIG. 9 is a cross-sectional view of the director plate and passage after second conical punching as shown in FIG. 8; and FIG. 10 is a cross-sectional view of the director plate an alternative second conical punch having a radius for providing a radiused inlet to the flow passage.

DESCRIPTION OF THE PREFERRED EMBODIMENTS

Figure 1:
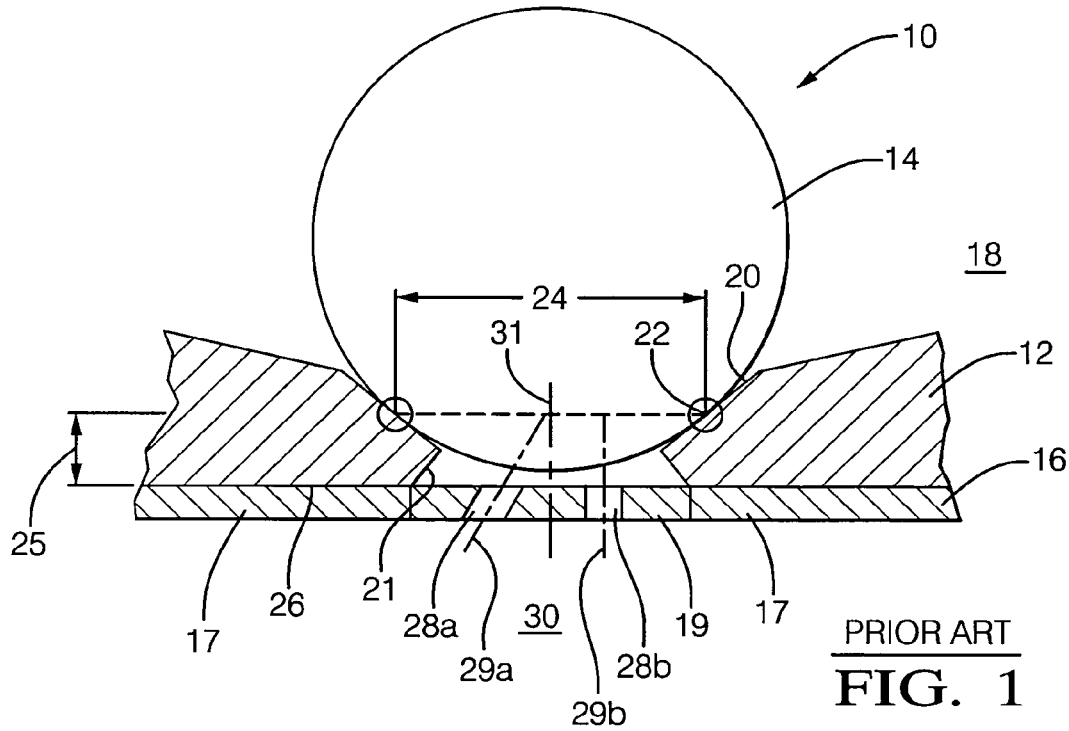
PRIOR ART FIG. 1
FIG. 1 is an elevational cross-sectional view of a prior art fuel injection valve assembly including a valve seat, a valve ball, and a director plate.

Referring to FIG. 1, a prior art fuel injection valve and director plate assembly 10 comprises a valve seat 12, a valve ball 14, and a director plate 16. As is well known in the prior art and need not be shown here, valve seat 12 is adapted to be sealingly welded into a body (not shown) of a fuel injector 18. Seat 12 is provided with an annular first conically beveled face 20 for receiving valve ball 14 in a circular sealing line 22 having a diameter 24 greater than the diameter of the injection opening in seat 12. First beveled face 20 typically terminates in a second beveled face 21 reverse-beveled from face 20 defining a conical exit opening to permit dispersal of fuel injected by the valve. Controllably varying the position of valve ball 14 with respect to face 20 controllably varies the flow of fuel across seat 12.

Prior art director plate 16 is coplanar with axial face 26 of seat 12 over both a peripheral portion 17 and a central portion 19 of plate 16. Central portion 19 is provided with a plurality of exemplary cylindrical distribution passages 28*a*,28*b* through plate 16 for discharging into manifold or firing chamber 30 fuel having passed across seat 12. Exemplary axis 29*a* of passage 28*a* is inclined to plate axis 31 such that fuel passing through passage 28*a* is discharged away from plate axis 31. Exemplary axis 29*b* of passage 28*b* is parallel to plate axis 31 such that fuel passing through passage 28*b* is discharged parallel to plate axis 31.

Figure 2:
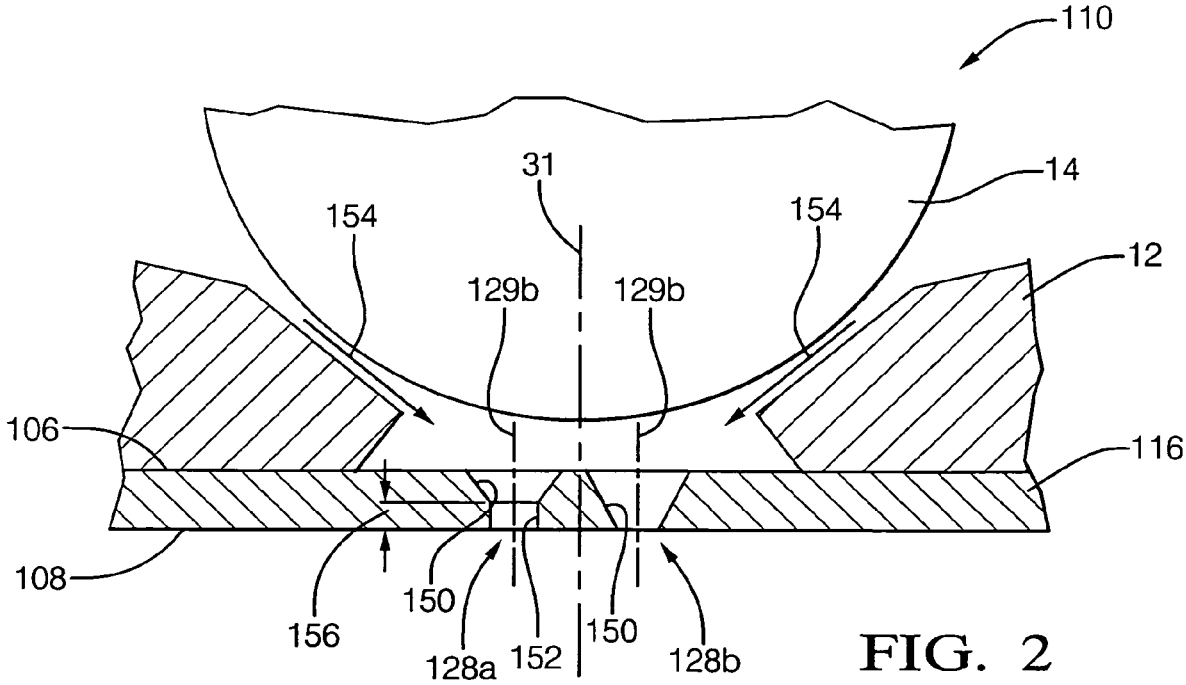
FIG. 2 is an elevational cross-sectional view of a fuel injection valve assembly including a valve seat, a valve ball, and an improved director plate.

Referring to FIG. 2, an improved fuel injection valve and director plate assembly 110 in accordance with the invention comprises a valve seat 12 and a valve ball 14 as in prior art assembly 10. Novel assembly 110 differs from prior art assembly 10 in that fuel flow passages 128 through improved director plate 116 between an upstream surface 106 and a downstream surface 108 are chamfered 150 at the upstream end, such chamfering being preferably conical. The chamfering of each passage may extend only part way through (128*a*), the remainder of the passage being cylindrical (152), or completely through (128*b*) plate 16. A second conical chamfer may also be imposed on top of the first chamfer, as discussed further, below (see FIG. 9). The axes 129*b* of the passages may be parallel to plate axis 31.

A serious disadvantage of prior art director plate 16 is that areas of low fuel flow or flow stagnation occur at the entrances and along the walls of passages 28. The relatively low fuel velocity in these areas permits deposits from fuel to form gradually. Flow visualization studies have shown that formation of deposits can be reduced or eliminated by eliminating such stagnation zones through the use of a taper at the entrance of the passage. Thus, in improved director plate 116, the entrances to the passages are chamfered as described above to increase the velocity of the fuel across the entrance of the passage along director plate surface 106 and to eliminate eddies and stagnant areas near the entrances within the passages. An especially useful placement of the chamfered entrances in the director plate is such that fuel flowing from the valve seat and ball in a main direction of flow 154 is received into the chamfered entrances 150 of passages 128. Thus, the walls of the chamfered portions are washed directly by fuel flowing at high velocity, preventing deposits from forming.

Figure 3:
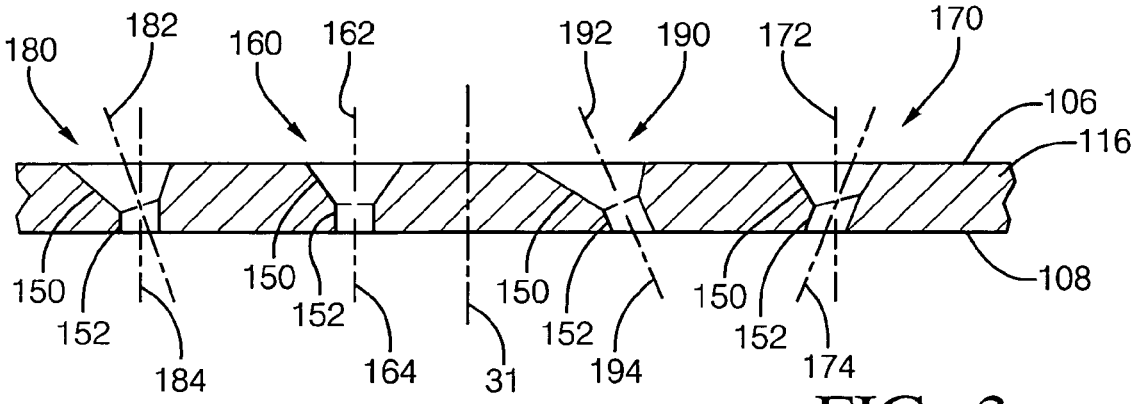
FIG. 3 is a schematic drawing showing various configurations of flow passages through an improved director plate.

A currently-preferred embodiment of a passage 128 in accordance with the invention is passage 128*a* comprising a chamfered upstream portion 150 and a cylindrical downstream portion 152 where the diameter of portion 152 is sized to control the volume of fuel exiting the director plate passage, and the length 156 of portion 152 is minimal, preferably less than the diameter of portion 152. Referring to FIG. 3, flow passages 128*a* may take any of several forms within the scope of the invention, some of which are exemplarily shown.

In passage 160, the conical axis 162 and the cylindrical axis 164 are both parallel with axis 31 of plate 116, as in passage 128*a* shown in FIG. 2.

In passage 170, the conical axis 172 is parallel with plate axis 31 and the cylindrical axis 174 is non-parallel with plate axis 31.

In passage 180, the conical axis 182 is non-parallel with plate axis 31 and the cylindrical axis 184 is parallel with plate axis 31.

In passage 190, both the conical axis 192 and the cylindrical axis 194 are non-parallel with plate axis 31.

Referring to FIGS. 4 through 10, a method in accordance with the invention is disclosed for forming one or more director plate chamfered flow passages.

Figure 4:
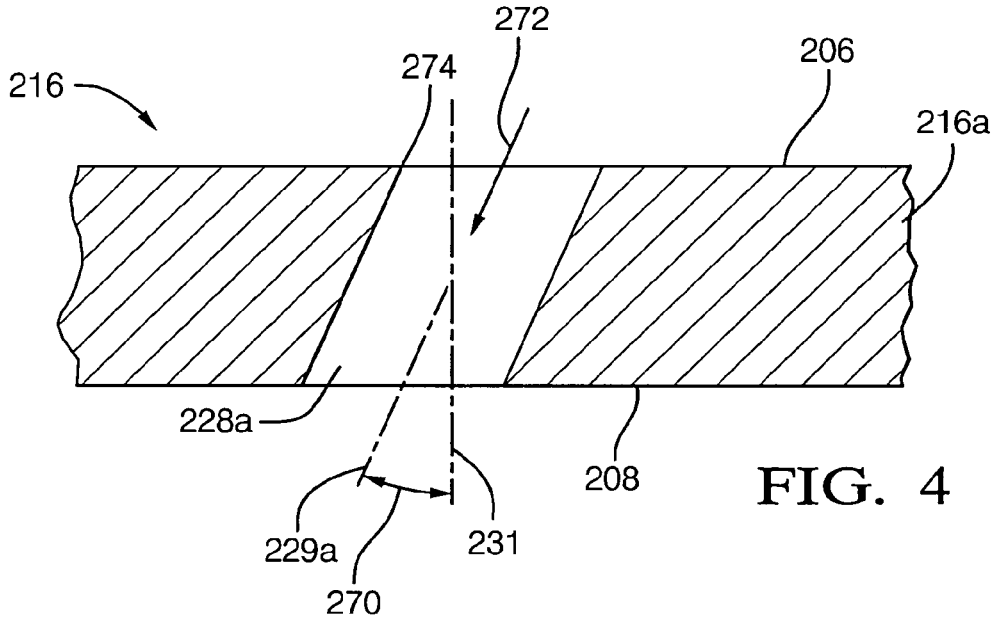
Figure 5:
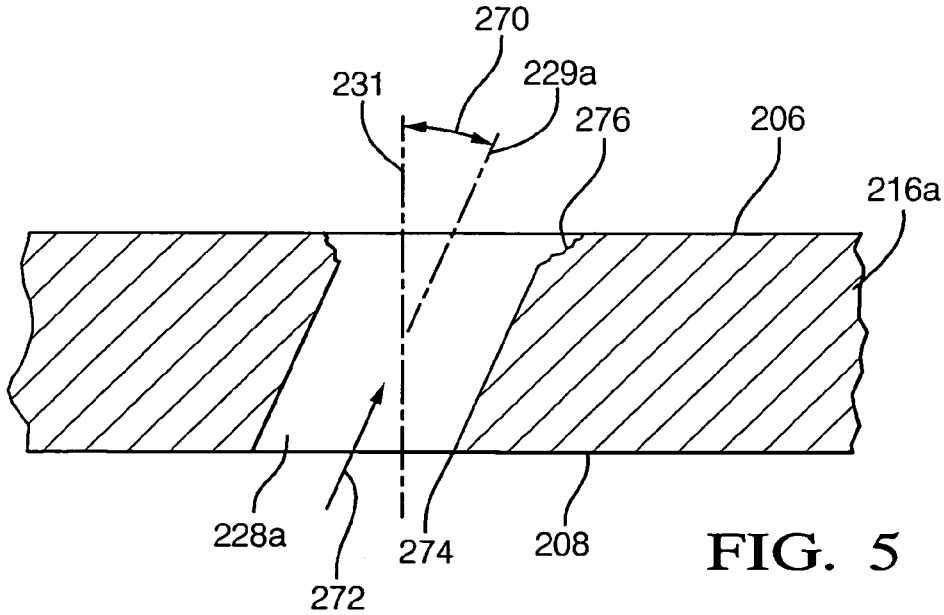

In FIGS. 4 and 5, a director plate blank 216 has an upstream surface 206 and a downstream surface 208. An exemplary cylindrical fuel flow passage 228*a* extends through plate 216. Axis 229*a* of passage 228*a* is inclined to plate axis 231 by a first angle 270. Passage 228*a* is formed preferably by stamping or punching (not shown) in a direction 272 entering from the downstream surface 208, as shown in FIG. 5, rather than from upstream surface 206, as shown in FIG. 4. This is principally because the punch-entering surface is left with a clean, sharp corner 274, rather than a torn-out corner 276 as tends to occur on the punch-exiting surface (omitted from surface 208 in FIG. 4). When the passage is formed as in FIG. 5, torn-out corner 276 and associated debris is eliminated in the next forming step as described below. The result of forming cylindrical passage 228*a* by punching or stamping in either direction is a first stage director plate 216*a*.

Figure 6:
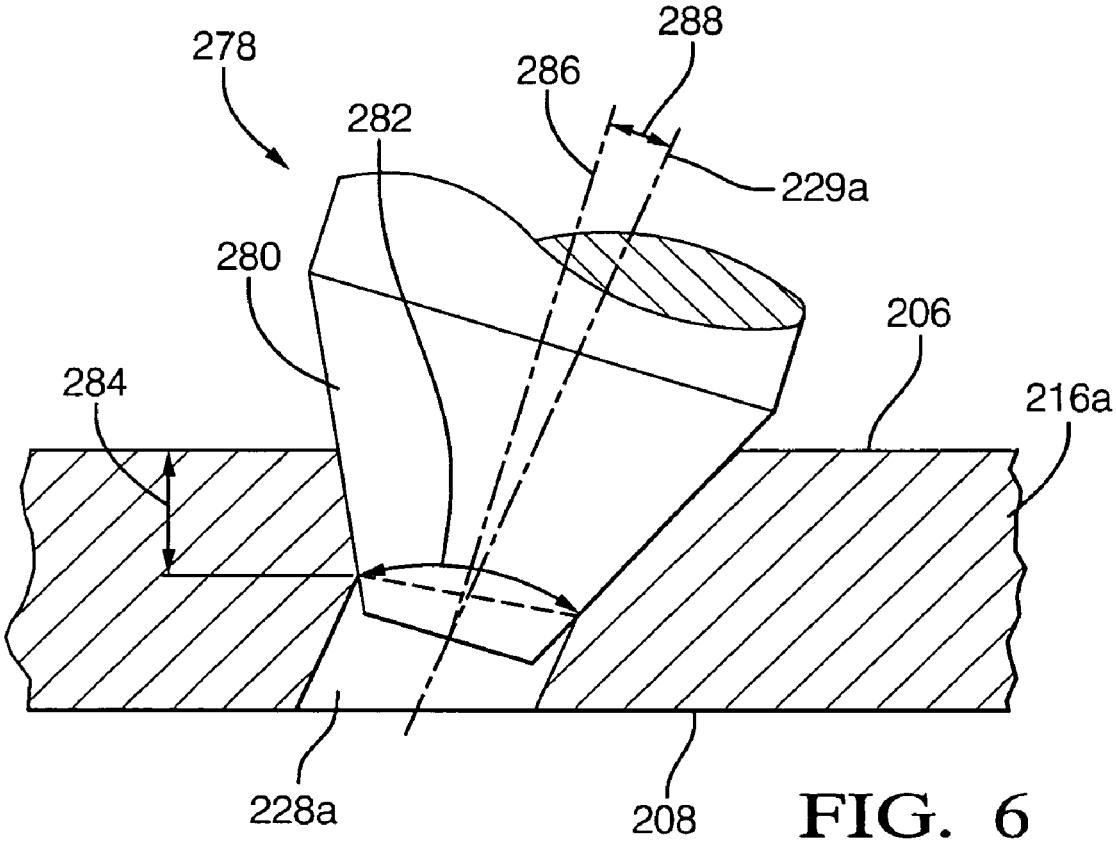
Figure 7:
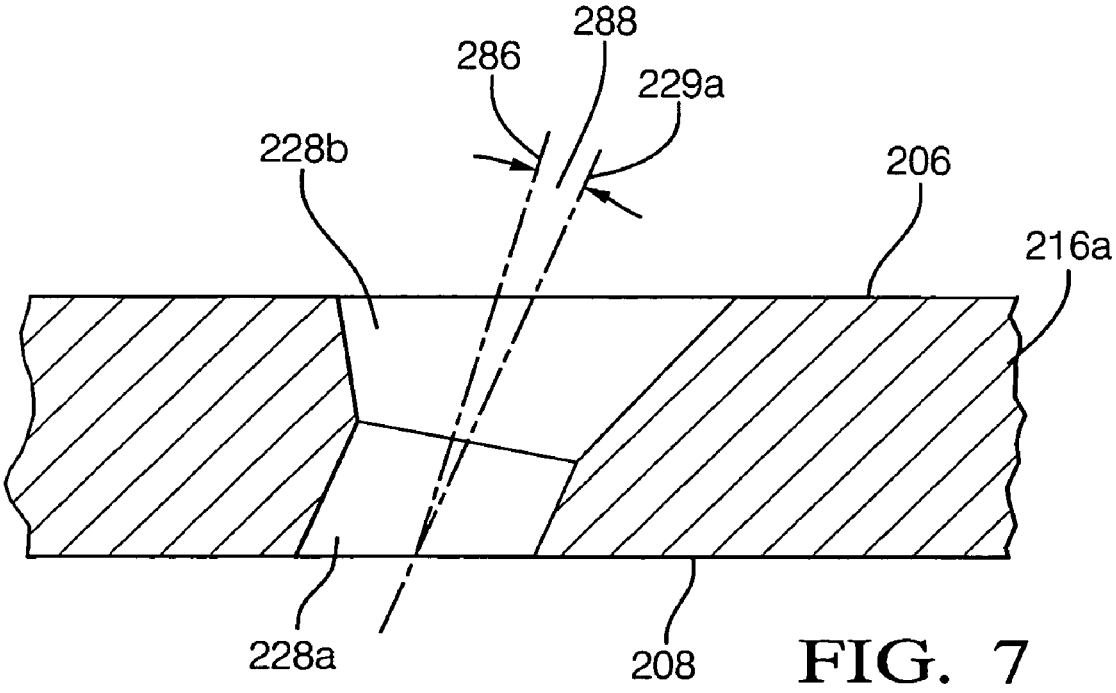

Referring to FIGS. 6 and 7, a first punch tool 278 having a frusto-conical portion 280 of a first included cone angle 282 is entered into passage 228*a* to a first depth 284. The axis 286 of frusto-conical portion 280 may be coincident with cylindrical axis 229*a* but preferably is inclined from axis 229*a* toward axis 231 by a second angle 288. The result of punching by tool 278 is a second stage director plate 216*a* having a residual portion of cylindrical passage 228*a* and a newly-formed conical passage portion 228*b*, as shown in FIG. 7.

Figure 8:
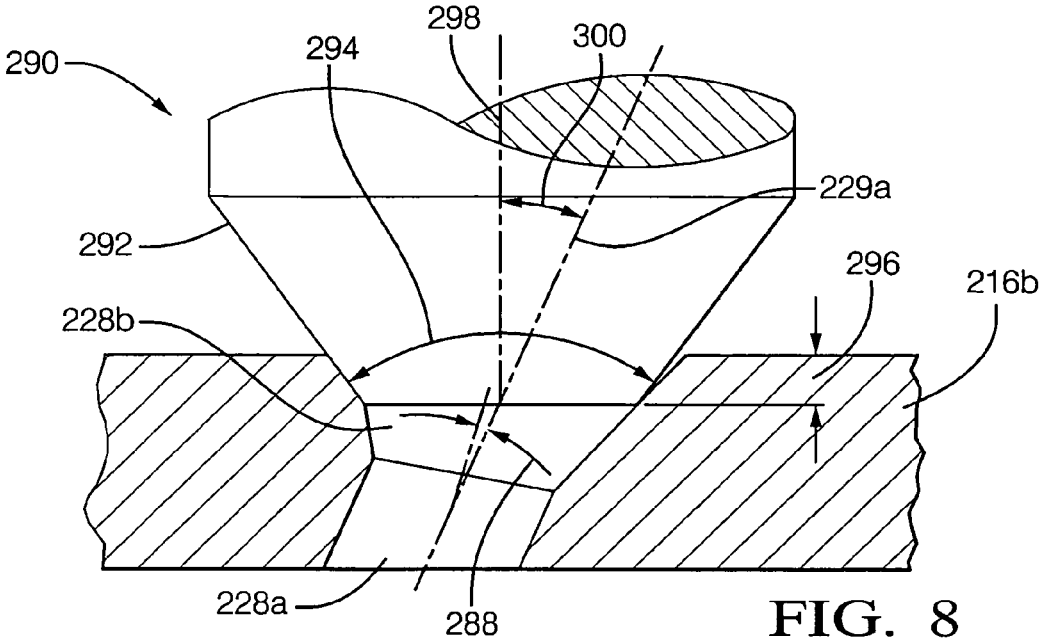
Figure 9:
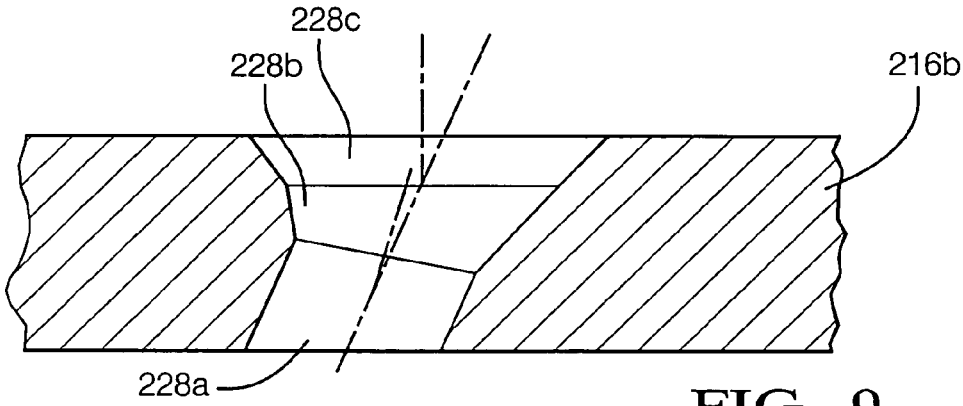

Referring to FIGS. 8 and 9, a second punch tool 290 having a frusto-conical portion 292 of a second included cone angle 294 is entered into conical passage portion 228*b* to a second depth 296. The axis 298 of frusto-conical portion 292 is preferably inclined to cylindrical axis 229*a* by an angle 300 which is larger than angle 288 and may equal angle 270 (FIGS. 4 and 5). The result of punching by tool 290 is a third stage director plate 216*b* having a residual portion of cylindrical passage 228*a*, a residual portion of first conical passage portion 228*b*, and a second conical passage portion 228*c*, as shown in FIG. 9.

Note that in some cases the use of second punch tool 290 may be omitted, for example, when the declination of first punch tool axis 286 from plate axis 231 is less than about 10-15°.

In some applications, the director plate at third stage 216*b* is ready for use. However, for maximum performance, a secondary process may be used to eliminate any burrs from the multiple stamping process just described, which process may include exemplarily fluid honing, electrochemical treatment, and the like.

For clarity of explanation, first and second conical portions 228*b*,228*c* are shown as being formed in two separate punching steps by two separate punch tools 278,290. It should be obvious to one of ordinary skill in the art of punch tools, however, that the shapes of the two punches can be formed in a single compound punch tool (not shown), and that director plate 216*b* may be formed from plate 216 in a single punching step. It is further possible to devise a multiply compound punch tool which punches portions 228*a*,228*b*,228*c* in a single stroke; the disadvantage of such a tool is that portion 228*a* then must be formed by punching in the same direction as portions 228*b*,228*c*, which has been shown to cause significant tear-out damage to the downstream corner 274 (FIG. 5). Thus it is a preferred method in accordance with the invention that cylindrical portion 228*a* is formed by punching or stamping in a first direction, and that conical portions 228*b*,228*c* are formed by punching in a second direction generally opposite to the first direction.

Figure 10:
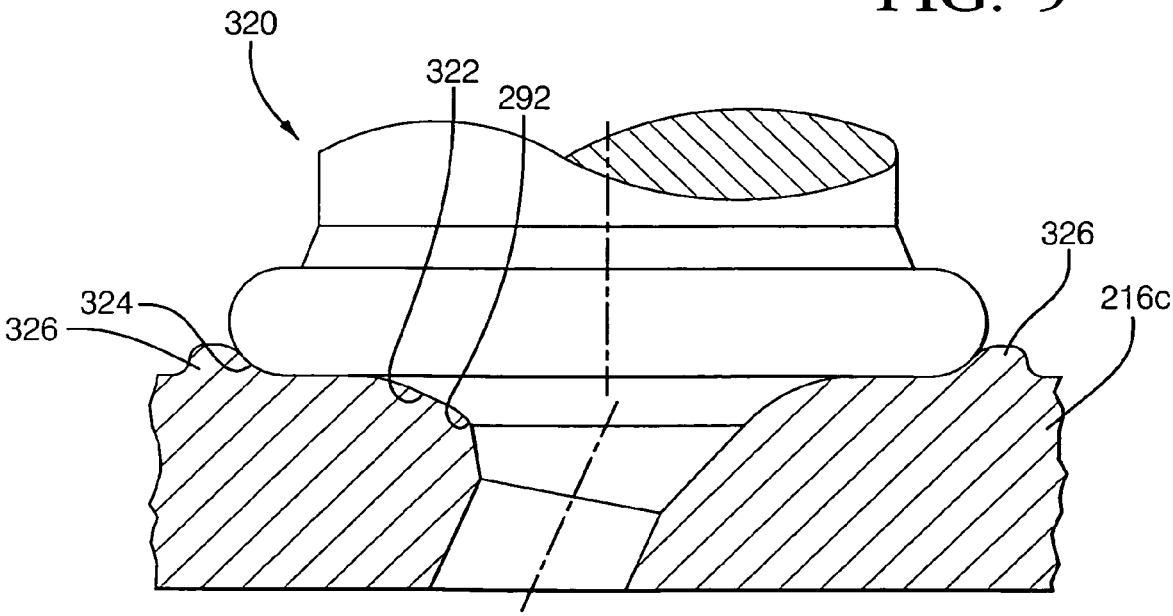

Referring to FIG. 10, in a radiusing punch tool 320, conical portion 292, shown previously in tool 290 is merged into a concave radius portion 322 to provide an even smoother fuel entrance into the fuel flow passage. Preferably, tool 320 includes a convex radius portion 324 outboard of portion 322 to laterally position residual plate material 326, removed from the flow passage during formation thereof, at a distance from the entrance to the flow passage. The result of using tool 320 is a director plate 216*c* having both a radiused entry into either a single conical or a doubly-conical and cylindrical fuel flow passage.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A spray director plate for use in directing fuel from a fuel injector valve assembly, said plate comprising a plurality of fuel passages extending therethrough between an upstream plate surface and a downstream plate surface, wherein at least one of said passages includes a first conical portion at the upstream surface end of said passage, a cylindrical portion extending from said first conical portion to said downstream surface, and a second conical portion disposed between said first conical portion and said cylindrical portion, said first conical portion having a first conical axis, said cylindrical portion having a cylindrical axis, and said second conical portion having a second conical axis, wherein either (i) said first conical axis is inclined to said second conical axis, or (ii) one of said first conical axis and said second conical axis is inclined to said cylindrical axis, or (iii) both (i) and (ii) are satisfied, and further wherein said first conical portion and said second conical portion diverge toward said upstream plate surface.

2. A plate in accordance with claim 1 wherein said first conical axis forms a first angle with said cylindrical axis, and wherein said second conical axis forms a second angle with said cylindrical axis, and wherein said first angle is greater than said second angle.

3. A fuel injector assembly comprising a spray director plate having a plurality of fuel passages extending therethrough between an upstream plate surface and a downstream plate surface, wherein at least one of said passages includes a first conical portion at the upstream plate surface end of said passage, a cylindrical portion extending from said first conical portion to said downstream plate surface, and a second conical portion disposed between said first conical portion and said cylindrical portion, said first conical portion having a first conical axis, said cylindrical portion having a cylindrical axis, and said second conical portion having a second conical axis, wherein either (i) said first conical axis is inclined to said second conical axis, or (ii) one of said first conical axis and said second conical axis is inclined to said cylindrical axis, or (iii) both (i) and (ii) are satisfied, and further wherein said first conical portion and said second conical portion diverge toward said upstream plate surface.

4. A fuel injector assembly in accordance with claim 3 wherein said first conical axis forms a first angle with said cylindrical axis, and wherein said second conical axis forms a second angle with said cylindrical axis, and wherein said first angle is greater than said second angle.

* * * * *